US006991206B1

(12) United States Patent
Sayles

(10) Patent No.: US 6,991,206 B1
(45) Date of Patent: Jan. 31, 2006

(54) CONCRETE BLOCK MOLD WITH IMPROVED STRIPPING ABILITY

(75) Inventor: Jerome D. Sayles, Nashotah, WI (US)

(73) Assignee: SoftSplit Technology, Inc., Menomonee Falls, WI (US)

( * ) Notice: Subject to any disclaimer, the term of this patent is extended or adjusted under 35 U.S.C. 154(b) by 240 days.

(21) Appl. No.: 10/610,667

(22) Filed: Jul. 1, 2003

Related U.S. Application Data

(60) Provisional application No. 60/432,951, filed on Dec. 12, 2002.

(51) Int. Cl.
*B28B 7/10* (2006.01)

(52) U.S. Cl. ..... 249/66.1; 249/140; 249/161; 425/443

(58) Field of Classification Search ..... 249/52, 249/55, 66.1, 140, 161; 425/443
See application file for complete search history.

(56) References Cited

U.S. PATENT DOCUMENTS 3,940,229 A 2/1976 Hutton
5,078,940 A 1/1992 Sayles
5,217,630 A 6/1993 Sayles
5,879,603 A 3/1999 Sievert
6,113,379 A 9/2000 LaCroix et al.
6,138,983 A 10/2000 Sievert
6,209,848 B1 4/2001 Bolles et al.
6,464,199 B1 * 10/2002 Johnson ..... 249/117

* cited by examiner

*Primary Examiner*—Donald Heckenberg
(74) *Attorney, Agent, or Firm*—Andrus, Sceales, Starke & Sawall, LLP

(57) ABSTRACT

An improved mold is provided for forming concrete blocks wherein the mold is of the type that has at least one wall having a plurality of spaced projections extending inwardly from the wall into a block material forming cavity. The at least one wall further includes a lip at a bottom of the wall extending inwardly into the cavity with the lip having an inwardly extending lip extension disposed along its bottom. The improvement includes having the lowermost projections in abutment with a top surface of the lip, and a vertical inner surface of each projection being coplanar with an upper vertical inner surface of the lip.

3 Claims, 3 Drawing Sheets

CONCRETE BLOCK MOLD WITH IMPROVED STRIPPING ABILITY

CROSS REFERENCE TO RELATED APPLICATION

This application relates to and claims priority from provisional U.S. Patent Application Ser. No. 60/432,951 filed Dec. 12, 2002.

FIELD OF THE INVENTION

This invention relates to an improved mold for forming concrete blocks and, more specifically, pertains to an improved mold for forming concrete blocks in which one or more surfaces of the block are irregular in appearance, providing a rough texture resembling that of a split block.

BACKGROUND AND SUMMARY OF THE INVENTION

In the manufacture of concrete blocks, it is known to split a cured composite block module along one or more splitting planes to provide an irregular surface to the block.

It is also known to form such a split-type block by utilizing a mold that has a number of projections extending inwardly into the cavity. Such a method and mold are shown in my U.S. Pat. No. 5,078,940 issued Jun. 7, 1992, which is herein incorporated by reference. Molds such as that shown in the '940 patent utilize projections and a lip to form the irregular face on the block. As the concrete block is stripped from the mold, concrete collects on and between the projections and the irregular pattern is formed. It has been found that excessive amounts of concrete would collect on and between the projections and the lip, thus increasing the amount of force needed to strip the concrete block from the mold. This increased force did not present an insurmountable problem in single face blocks, but in multiple face blocks stripping was made very difficult, if not impossible.

The present invention eliminates any spaces or gaps between the projections and the lip for the concrete to gather in, thus making stripping of the concrete block much easier. It has also been found that with the use of this improved mold, both the feed time and the finish time can be increased, resulting in a superior product.

It has further been realized that the amount of material wasted during forming of the block can be reduced by as much as 50 percent.

It is a general object of the present invention to provide a block forming mold which has improved stripping ability, and is capable of more quickly and efficiently forming an irregular split-type block surface.

It is one object of the present invention to provide a block forming mold which markedly reduces wasted block material.

It is an additional object of the present invention to provide a block forming mold which lessens disturbance to the block by reducing friction during stripping and contributes to a decrease in cracking of the formed block.

It is a further object of the present invention to provide a block forming mold which enables the formation of a stronger, harder product exceeding increased use specifications.

It is also an object of the present invention to provide a block forming mold which produces a block which is cleaner in appearance and dimensionally correct.

In one aspect of the invention, a mold is provided for forming concrete block. The mold includes a plurality of interconnected vertical walls defining a block material forming cavity having a top opening and a bottom opening with at least one of the walls having a plurality of spaced projections extending inwardly from the wall into the cavity, and a lip at a bottom of the wall beneath the lowermost of the projections extending inwardly into the cavity. The lip has a top surface, a bottom surface and an inwardly extending lip extension disposed along the bottom surface. The invention is improved with the lip being formed with an upper vertical inner surface extending from the top surface to the lip extension. The invention is further improved with the lowermost of the projections having a bottom surface in abutment with the top surface of the tip, and a vertical inner surface coplanar with the upper vertical inner surface of the lip.

In another aspect of the invention, a mold used in a concrete block forming process includes a plurality of interconnected vertical walls defining a cavity having a top opening and a bottom opening adapted to receive concrete block forming material containing aggregate through the top opening, and to discharge formed block material in the form of the concrete block having a length, a width, and a height. At least one of the walls has a number of spaced projections extending inwardly from the at least one wall into the cavity. The at least one wall further includes a lip at a bottom of the wall beneath the lowermost of the projections extending inwardly into the cavity with the lip having a top surface and an inwardly extending lip extension disposed along a bottom surface of the lip. The lip is formed with an upper vertical surface extending from the top surface of the lip to the lip extension. The lowermost of the projections has a bottom surface in abutment with the top surface of the lip, and a vertical inner surface coplanar with the upper vertical surface of the lip. A shoe is engaged with an upper surface of the block forming material and is mounted for sliding movement relative to the vertical walls during the concrete block forming process. The shoe has at least one edge adjacent the projections and is spaced from the lip extension to define a surfacing gap through which waste material from the concrete block forming process will fall. The surfacing gap is determined substantially by a largest size of the aggregate in the block forming material, and the height of the concrete block to be formed.

Various other features, object and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE PREFERRED EMBODIMENT

Prior Art

Figure 1:
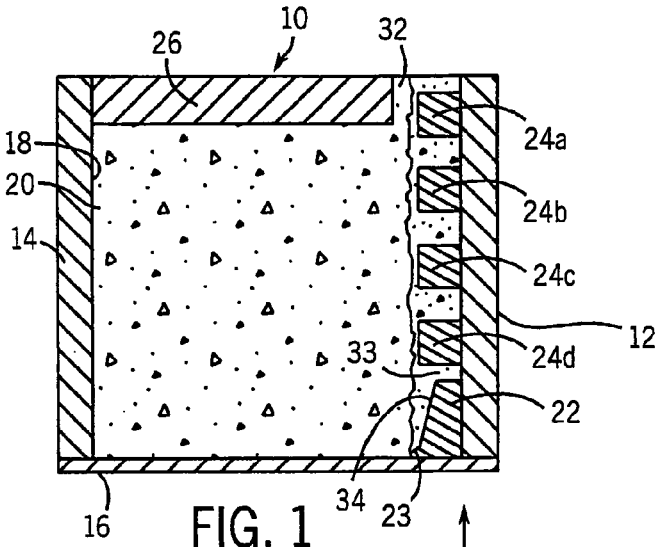
FIG. 1 (PRIOR ART)
FIG. 1 is a sectional view of a prior art concrete block mold.
Figure 2:
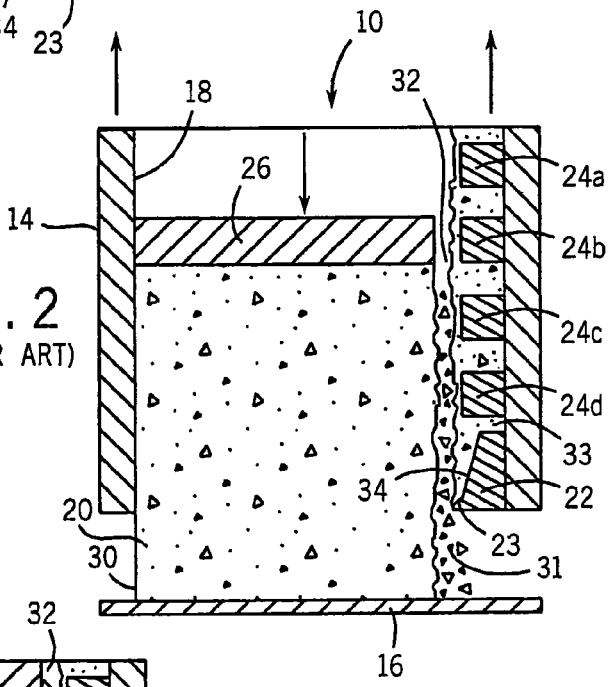
FIG. 2 (PRIOR ART)
FIG. 2 is a sectional view similar to FIG. 1 showing the use of the prior art mold.
Figure 2A:
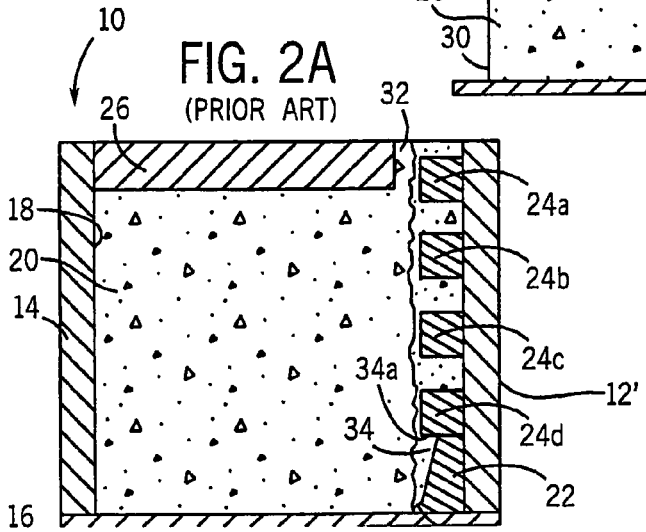
FIG. 2A (PRIOR ART)
FIG. 2A is a view similar to FIG. 1 showing an alternative prior art mold.

Referring now to FIGS. 1, 2 and 2A, thereshown is a prior art concrete block forming mold 10 which is well known. Mold 10 includes a face plate 12, a rear portion 14 and a lower plate 16, all of which cooperate along with side walls (not shown) to form a cavity 18 adapted to receive therein a block forming material 20. Material 20 is a standard mix of sand, native aggregate, cement, mortar and water as is well known in the block forming art.

Face plate 12 includes a rearwardly extending lip 22 with a lip extension 23 at a bottom thereof, and a series of rearwardly facing projections 24*a*–24*d* above the lip 22 extending into a first portion of the cavity 18 to retain material 20 therein. An upwardly and downwardly moveable shoe 26 is slidably mounted in the mold 10. When mold 10 is in the position shown in FIG. 1, material 20 is deposited and vibrated in the cavity 18, after which the shoe 26 is placed against the top of the poured material 20 to form and compact a flat top surface of the material 20. The material 20 sets for a short interval and then face plate 12 and rear wall 14 of mold 10 and the lower plate 16, are moved relative to each other to form the block 30 as seen in FIG. 2. At the same time, the shoe 26 is moved against the top of the material 20 to urge the block forming material 20 out of the mold 10. When this occurs, the volume of material 20 contained in the first portion of cavity 18 defined by face plate 12 remains in place due to projections 24*a*–24*d*. This action essentially shears or splits the material 20 providing an irregular split-type surface 28 to the block shown at 30. Some fragmentation of material 20 occurs during the forming action, causing waste material 31 to fall through a surfacing gap 32 to be discussed further hereafter. When the upper surface of formed block 30 has cleared the bottom of the mold 10, the shoe 26 is retracted and lower plate 16 is removed to carry block 30 to a curing area.

FIG. 2A shows an alternative face plate 12' which also has been used to form a concrete block.

It is extremely important to acknowledge the criticality of gap 32 which is formed between the end of the lip extension 23 and the edge of the shoe 26 adjacent the face plate 12 or 12'. This gap 32 is generally defined according to the largest size of the native aggregate used in the block forming material 20, and a desired height of the block 30 to be formed in the mold 10. Typically, the larger the aggregate used and the higher the height of the block 30 desired dictates a correspondingly sized, larger gap 32. If the gap 32 is not properly chosen, the block forming process will incur too much friction and waste material 31 being sheared will not be properly relieved from the mold 10.

When forming blocks 30 using the face plates 12 and 12', it has been found that concrete block forming material 20 tends to collect in the spaces 33 between the lowermost projections 24*d* and the lip 22 as well as on a sloping face 34 of the lip 22 or an extension 34*a* (FIG. 2A). Such accumulation of material 20 increases the amount of force required to strip the block 30 from the mold 10. This undesirable material retention negatively impacted on the efficiency of the block forming method and affected the quality of the block as discussed in the Background of the Specification.

The Present Invention

Figure 3:
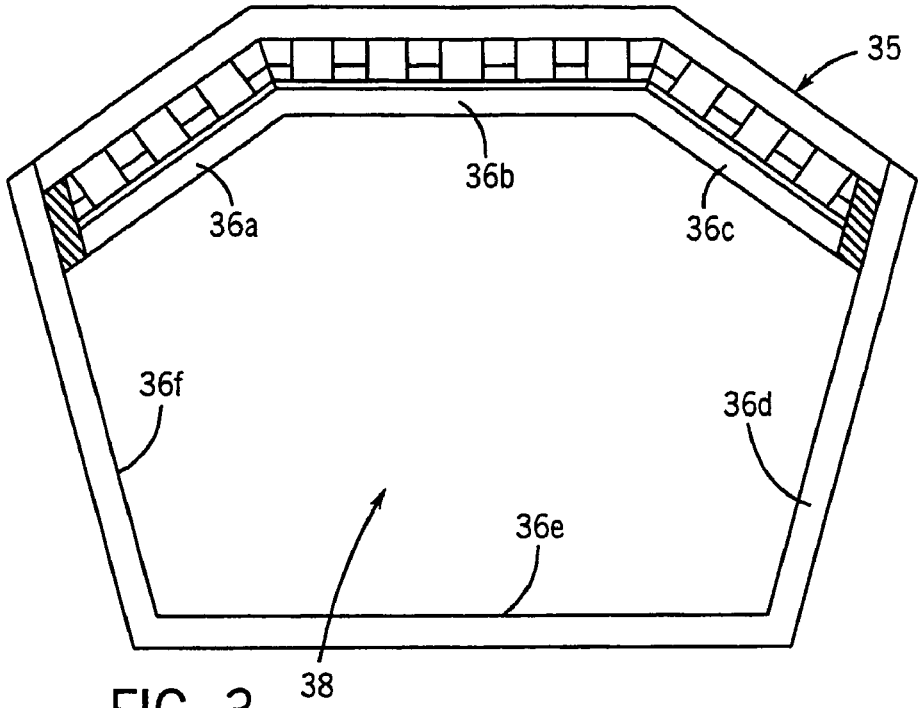
FIG. 3 is a top view of the concrete block mold constructed in accordance with the present invention.

FIG. 3 shows an improved concrete block mold 35 including a plurality of interconnected vertical walls 36*a*–36*f* forming a central cavity 38.

Figure 4:
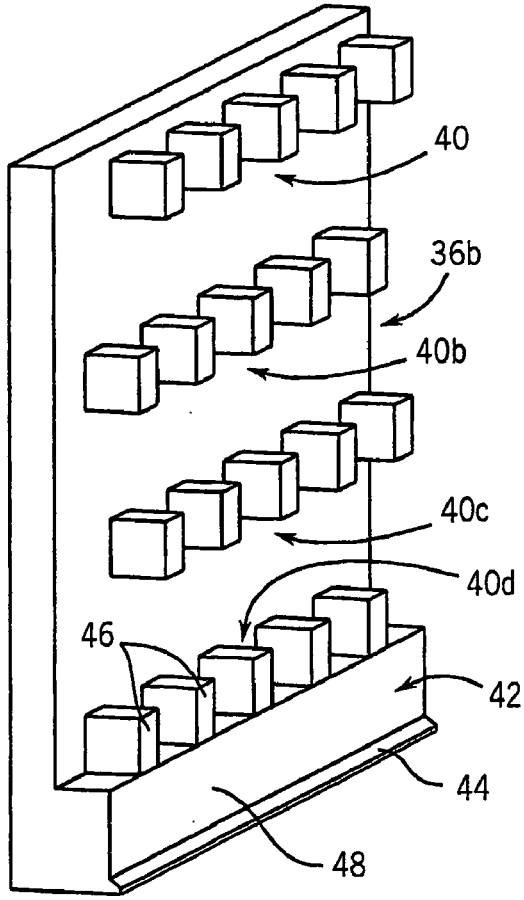
FIG. 4 is a perspective view of a face plate of the present invention.
Figure 5:
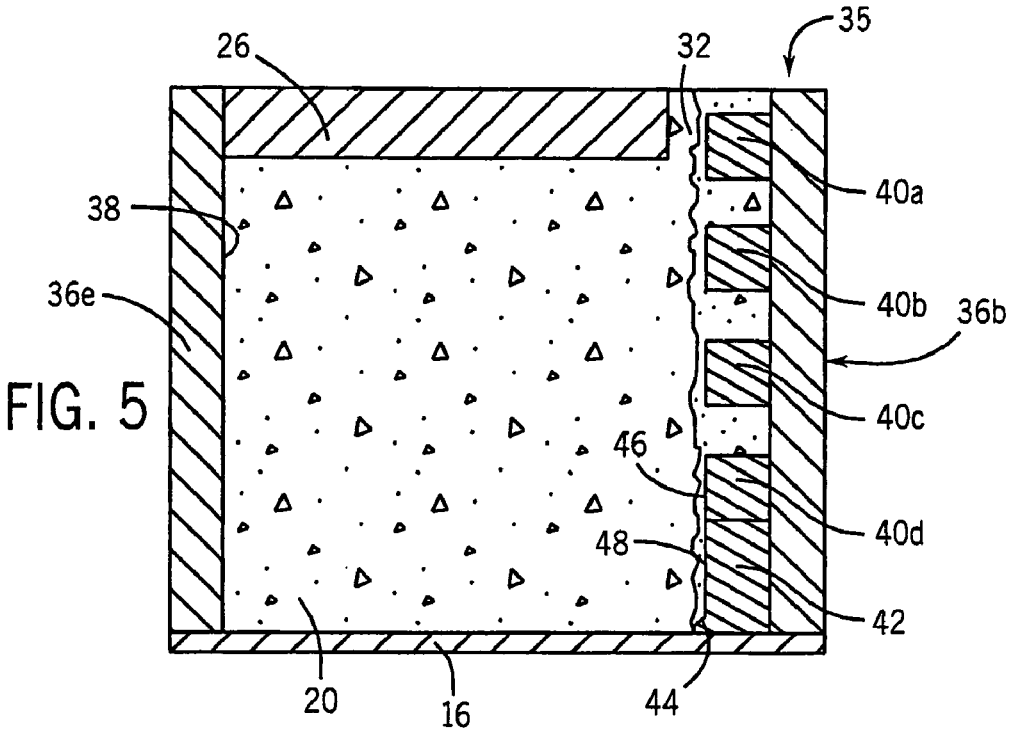
FIG. 5 is a sectional view of the face plate of FIG. 4.
Figure 6:
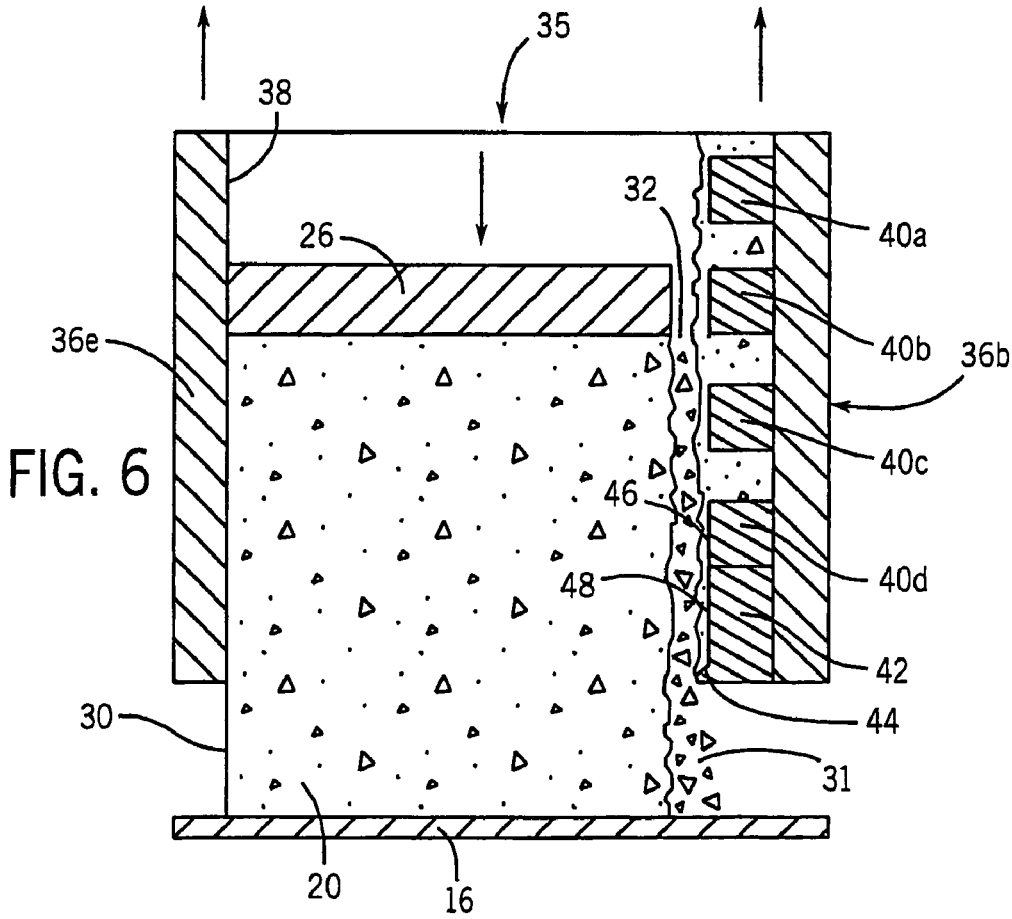
FIG. 6 is a sectional view like FIG. 2 showing the face plate of the present invention.

At least one vertical wall 36*b* and preferably several of the vertical walls 36*a*–36*f* is a face plate. Each vertical wall and face plate, such as shown at 36*b* in FIG. 4, is provided with a plurality of projections 40*a*–40*d* extending inwardly in the cavity 38. Vertical wall and face plate 36*b* is also provided with a lip 42 located at a bottom thereof and extending into the cavity 38. Lip 42 is provided with an inwardly extending lip extension 44 disposed along a bottom surface of the lip 42. In accordance with the invention best seen in FIGS. 5 and 6, the lowermost row 40*d* of projections 40*a*–40*d* has its bottom surface in abutment with the top surface of the lip 42, and a vertical inner surface 46 coplanar with a vertical inner surface 48 extending between top surface of the lip 42 and the lip extension 44.

This design thus eliminates any spaces 33 or sloping faces 34 or extensions 34*a* where block forming material 20 tended to deleteriously accumulate. With this construction, the ability to strip the formed blocks 30 from the mold 35 is vastly improved resulting in a more efficient method and a significantly enhanced product. More particularly, the formed blocks 30 produced from the new mold 35 exhibit less cracking, are cleaner in appearance and more dimensionally correct, and are clearly stronger, denser products. The improved mold thus operates to avoid the drawbacks of the prior art by preventing formed blocks 30 from hanging up in the mold 35 and then dropping down onto the lower plate or support surface 16. Thus, the amount of impaired or damaged blocks is minimized.

While the invention has been described with reference to a preferred embodiment, those skilled in the art will appreciate that certain substitutions, alterations and omissions may be made without departing from the spirit thereof. Accordingly, the foregoing description is meant to be exemplary only and should not be deemed limitative on the scope of the invention set forth with the following claims.

I claim:

1. In a mold for forming concrete block wherein the mold includes a plurality of interconnected vertical walls defining a block material forming cavity having a top opening and a bottom opening with at least one of the walls having a plurality of spaced projections extending inwardly from the wall into the cavity, and a lip at a bottom of the wall beneath the lowermost of the projections extending inwardly into the cavity with the lip having a top surface and an inwardly extending lip extension disposed along a bottom surface, the improvement comprising:

the lip being formed with an upper vertical inner surface extending from the top surface to the lip extension; and the lowermost of the projections having a bottom surface in abutment with the top surface of the lip, and having a vertical inner surface coplanar with the upper vertical inner surface of the lip.

2. A mold used in a concrete block forming process comprising:

a plurality of interconnected vertical walls defining a cavity having a top opening and a bottom opening adapted to receive concrete block forming material containing aggregate through the top opening, and to discharge formed block material in the form of a concrete block having a length, a width and a height, at least one of the walls having a number of spaced projections extending inwardly from the at least one wall into the cavity, the at least one wall further including a lip at a bottom of the wall beneath the lowermost of the projections extending inwardly into the cavity with the lip having a top surface and an inwardly extending lip extension disposed along a bottom surface of the lip, the lip being formed with an upper vertical surface extending from the top surface of the lip to the lip extension, the lowermost of the projections having a bottom surface in abutment with the top surface of the lip, and a vertical inner surface coplanar with the upper vertical surface of the lip; and a shoe engaged with an upper surface of the block forming material and mounted for sliding movement relative to the vertical walls during the concrete block forming process, the shoe having at least one edge adjacent the projections and spaced from the lip extension to define a surfacing gap through which waste material from the concrete block forming process will fall.

3. The mold of claim 2, wherein the surfacing gap is determined substantially by a largest size of the aggregate in the block forming material, and the height of the concrete block to be formed.

* * * * *